United States Patent [19]

Sanmi et al.

[11] 4,354,849

[45] Oct. 19, 1982

[54] EXHAUST GAS DISCHARGE AND COOLING MEANS FOR OUTBOARD ENGINES

[75] Inventors: Yasumaru Sanmi; Norimichi Harada; Yasuhiro Nishida, all of Hamamatsu, Japan

[73] Assignee: Yamaha Hatsudoki Kabushiki Kaisha, Iwata, Japan

[21] Appl. No.: 76,156

[22] Filed: Sep. 17, 1979

Related U.S. Application Data

[63] Continuation of Ser. No. 841,585, Oct. 12, 1977, abandoned.

[30] Foreign Application Priority Data

Oct. 13, 1976 [JP] Japan ..... 51-138054
Oct. 13, 1976 [JP] Japan ..... 51-138055

[51] Int. Cl.[3] ..... B63H 23/32
[52] U.S. Cl. ..... 440/88; 440/89
[58] Field of Search ..... 60/310; 123/41.31; 440/88, 89, 900

[56] References Cited

U.S. PATENT DOCUMENTS

| | | | |
|---|---|---|---|
| 3,195,521 | 7/1965 | Larsen | 115/17 X |
| 3,198,162 | 8/1965 | Larsen | 115/17 |
| 3,310,022 | 3/1967 | Kollman | 115/17 |
| 3,431,882 | 3/1969 | Irgens | 115/17 |
| 3,520,270 | 7/1970 | Miller | 115/17 |
| 3,750,615 | 8/1973 | Haft et al. | 115/18 R |
| 4,036,162 | 7/1977 | Maier et al. | 115/17 |

*Primary Examiner*—Sherman D. Basinger
*Attorney, Agent, or Firm*—Donald D. Mon

[57] ABSTRACT

An outboard engine is supported on a casing which forms an internal discharge chamber having an opening at its top end and a discharge passage with a discharge port near its lower end. The cooling water discharge pipe and an exhaust pipe discharge into the chamber, the cooling water discharge pipe doing so at a lower elevation than the exhaust pipe. A water storage chamber is formed between the casing and the exhaust pipe in heat transfer relationship therewith, and circulation of water is provided to and from the water storage chamber.

12 Claims, 5 Drawing Figures

EXHAUST GAS DISCHARGE AND COOLING MEANS FOR OUTBOARD ENGINES

CROSS REFERENCE TO OTHER APPLICATION

This is a continuation of applicant's co-pending patent application, Ser. No. 841,585, filed Oct. 12, 1977, now abandoned, entitled "Discharge of Exhaust Gas and Cooling Water in Outboard Engines", now abandoned.

This invention relates to discharge means for exhaust gas and cooling water, and a cooling means for the exhaust pipe of an outboard engine.

In an outboard engine, the engine is customarily disposed on the upper end of a casing, and exhaust gas and the cooling water from the engine are discharged into the casing. The casing is connected to the exhaust pipe, which communicates to it the pressure at the exhaust ports of the engine. This pressure is pulsational, and can even be negative. Accordingly, cooling water is sometimes drawn back into the exhaust pipe, and even into the engine through the exhaust pipe. This decreases the performance of the engine and is a source of corrosion. Such circumstances frequently occur in an engine of simplified construction wherein the exhaust pipe and cooling water discharge pipe are integrally formed. An object of the present invention is to provide discharge means in which the above risk is eliminated and in which the backflow of cooling water into the exhaust pipe is prevented.

Another problem in presently known outboard engines is the over-heating of the outer surface of the casing as a consequence of heat transfer from the exhaust pipe. This makes it difficult to handle the engine and is deleterious to the packing and sealing materials used therein.

It is another object of this invention to provide cooling means for the exhaust pipe to avoid the above disadvantages.

This invention is accomplished in combination with a casing adapted to support an outboard internal combustion engine. The casing forms an internal discharge chamber with an opening at its top end and a discharge passage having a discharge port near its lower end. In one embodiment of the invention, a cooling water discharge pipe in the chamber has its inlet adjacent to the top end and its outlet at a first elevation in the discharge chamber. The inlet is adapted to be communicated with a cooling water outlet from the engine. An exhaust pipe is formed in the discharge chamber having its inlet near the top end and its outlet in the discharge chamber at a second elevation therein. The second elevation is higher than the first elevation, whereby to discourage backflow of exhausted cooling water from the discharge chamber into the exhaust pipe. The exhaust pipe is adapted to be connected to an exhaust port of the engine. Both of the elevations are higher than the discharge port from the casing.

According to another embodiment of the invention, a water storage chamber is formed between the casing and the exhaust pipe in heat transfer relationship to the exhaust pipe whereby circulation of water through the water storage chamber cools the exhaust pipe and protects the casing against overheating.

The above and other features of this invention will be fully understood from the following detailed description and the accompanying drawings in which.

Figure 1:
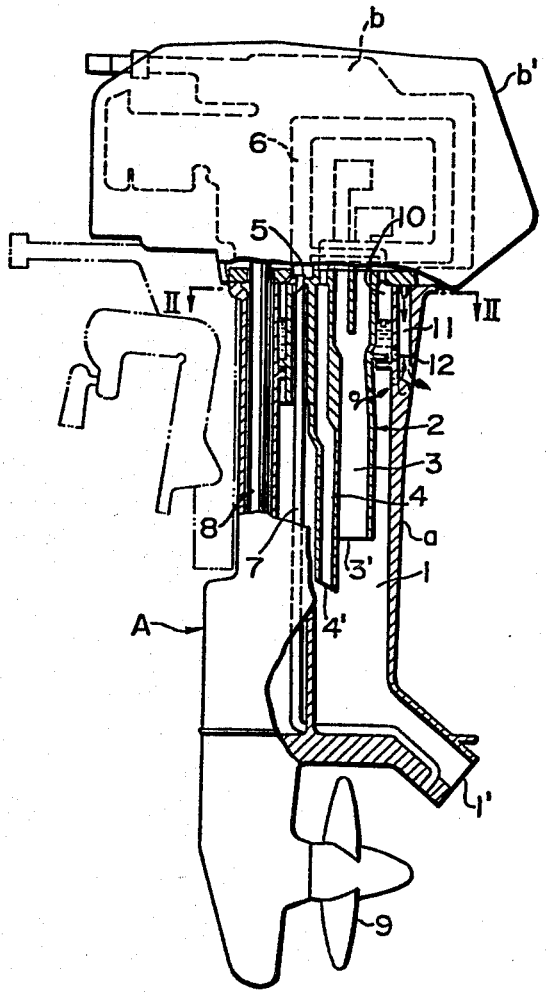
FIG. 1 is a side elevation, partly in vertical cross-section, showing one embodiment of the invention.
Figure 2:
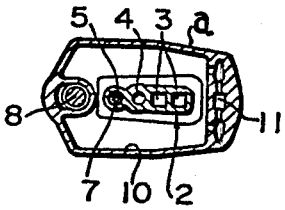
FIG. 2 is a cross-section taken at line II—II in FIG. 1.

In FIGS. 1 and 2 there is shown an outboard engine main body (A) comprising a casing (a). An outboard internal combustion engine (b) is supported on the upper end of casing (a), and engine (b) is covered with an engine cowling (b'). The casing (a) has therein a discharge passage (1) with an opening at its top end and extending to the rear surface of the lower portion thereof. The lower end of discharge passage (1) is opened to form a discharge port (1') below the expected water line in operation.

In discharge passage (1), a unit (2) consisting of exhaust pipe (3), cooling water discharge pipe (4) and a water suction pipe supporting passage (5) which are integrally formed is inserted from the upper end of the casing and fixed therein. The exhaust pipe (3) is connected to the exhaust port of engine (b), and the lower portion thereof is extended by a suitable length into passage (1). The cooling water discharge pipe (4) is formed on and in parallel to the front surface of exhaust pipe (3), and the upper end of cooling water discharge pipe (4) is connected to the terminal end portion of a cooling water circulation pipe (6) in the engine.

The lower ends of exhaust pipe (3) and cooling water discharge pipe (4) are opened to form discharge ends (3') and (4') so that discharge end (4') of cooling water discharge pipe (4) is at a first elevation which is lower than the elevation of the discharge end (3') of exhaust pipe (3). Cooling water pipe 4 has only an inlet and only an outlet, as shown. The water suction pipe supporting passage (5) is formed on the front surface of cooling water discharge pipe (4), and, in this supporting passage (5), a cooling water suction pipe (7) is inserted and supported. The lower end of suction pipe (7) opens through the lower portion of casing (a), while the upper end thereof is connected to the inlet of cooling water circulation pipe (6). The elevations of ends 3' and 4' are both higher than the elevation of port 1'.

The exhaust gas from engine (b) is introduced into exhaust pipe (3) and flows into passage (1) in casing (a) from discharge end (3') of exhaust pipe (3), and it is thereafter discharged into water from discharge port (1').

Cooling water, such as sea-water is admitted into cooling water circulation pipe (6) through water suction pipe (7) to cool the engine, and is then introduced into cooling water discharge pipe (4) from the terminal end portion of circulation pipe (6). The cooling water thereafter flows into passage (1) in casing (a) from discharge end (4') of cooling water discharge pipe (4), and it is then discharged with the above-mentioned exhaust gas into the water from discharge port (1').

In the drawings, reference numeral (8) denotes a drive shaft connected to engine (b) to transmit the rotary movement thereof to a propeller (9). A water storing chamber 10 is formed on the upper circumferential surface of unit (2). A discharge pipe 11 discharges exhaust gas into the atmosphere. Water storing chamber (10) is connected to cooling water circulation pipe (6) to supply cooling water thereinto so that the base portion of exhaust pipe (3) is cooled. The water storing chamber (10) is communicated with discharge pipe (11) via a small hole (12), and the cooling water in chamber (10) is discharged through discharge pipe (11).

Because the elevation of the discharge end of the cooling water discharge pipe is lower than that of the exhaust pipe, cooling water discharged from the cooling water discharge pipe is not sucked into the exhaust pipe even when a negative pressure appears in the exhaust pipe as a consequence of exhaust gas pulsation. The discharge end of the cooling water discharge pipe is sufficiently below that of exhaust pipe to accomplish this objective. Therefore, the means of the present invention permits preventing the ill effects prevailing in prior art means, because it prevents cooling water, such as seawater from being sucked into exhaust pipe or engine through the exhaust pipe.

Figure 3:
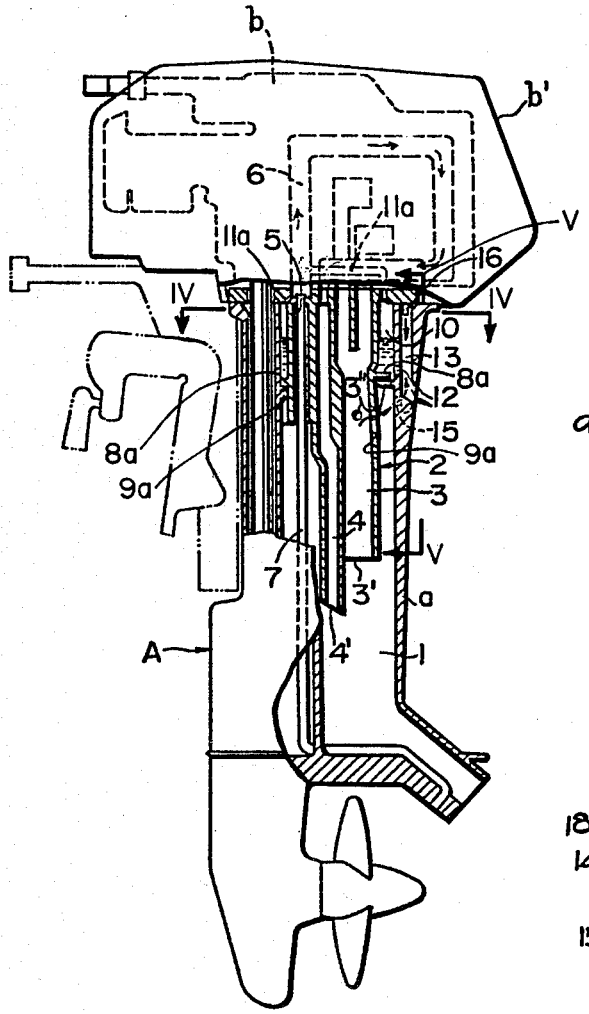
FIG. 3 is a view similar to FIG. 1 showing another embodiment of the invention.
Figure 4:
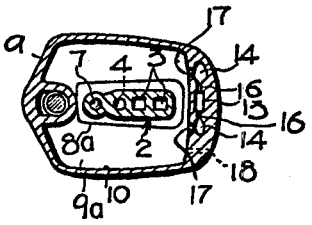
FIGS. 4 and 5 are cross-sections taken at lines IV—IV and V—V respectively, in FIG. 3.
Figure 5:
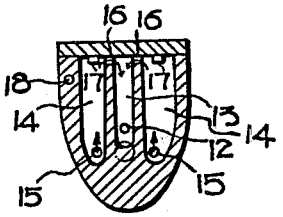

The apparatus of FIGS. 3–5 is identical in many respects to that of FIGS. 1 and 2. It shows the best known mode, and the presently preferred embodiment of the invention. The same numbers being used in both sets of FIGS. to describe the same parts. To the extend these parts are duplicative, they will not again be described.

Exhaust pipe 3 in this embodiment has a number of discharge holes 3″ through its circumferential wall.

In this embodiment, unit 2 includes an external flange 8*a* formed integrally with it which is spaced from the upper end of the unit. Flange 8*a* is sealingly supported by means of a seal on a flange, 9*a* that projects from the inner surface of discharge passage (1). This forms the water storing chamber (10) in the upper portion of the inside of casing (a). The base portion of exhaust pipe (3) is thereby surrounded by water storing chamber (10).

Water storing chamber (10) is connected to the starting end of cooling water circulation pipe (6) via water passage 11*a*; 11*a* connected to the upper end of water storing chamber (10) to supply water through passages 11*a*, 11*a* into water storing chamber (10). Water storing chamber (10) is provided with a small hole (12) at the bottom portion thereof so that water storing chamber (10) is thereby communicated with an upper discharge passage (13) formed in the upper portion of the rear wall of casing (a).

A required amount of cooling water is kept in water storing chamber (10) by discharging cooling water into upper discharge passage 13 through small hole 12. Casing (a) is provided with an atmosphere communication hole (18) in the upper portion of the rear wall thereof to communicate the upper portion of water storing chamber (10) with the atmosphere and keep the inside of water storing chamber (10) at an atmospheric pressure.

Thus, the circumference of the base portion of exhaust pipe (3) is cooled with the cooling water in water storing chamber (10). In the upper portion of the rear wall of casing (a), exhaust gas passages (14) are formed on both sides of upper discharge passage (13), and passages (14) are spaced from passage (13) and parallel thereto. The lower ends of these passages (14) are communicated with discharge passage (1) via holes (15), while the upper ends thereof are communicated with upper discharge passage (13) via holes (16), (16).

When, during the idling of the engine, water pressure is applied to the outlet at the lower end of discharge passage (1) to make it difficult to discharge exhaust gas therefrom, the exhaust gas flowing out of discharge end (3′) and discharge hole (3″) of exhaust pipe (3) can be discharged into the atmosphere via holes (15), (15), exhaust gas passages (14), (14), holes (16), (16) and upper discharge passage (13). Needless to say, the exhaust gas is discharged from both the outlet of discharge passage (1) and upper discharge passage (13) while the engine is normally operated.

The upper ends of exhaust gas passages (14), are communicated with the upper portion of water storing chamber (10) via communication holes (17) to muffle the sound of exhaust gas passing through exhaust gas passages (14) by utilizing the volume of water storing chamber (10).

According to the present invention as described above, the base temperature caused by the heat of exhaust gas from the outboard engine is lowered with cooling water supplied from water storing chamber and then, the overheating of the outer surface of the engine, such as the outer surface of casing which is near the exhaust pipe can be prevented. This allows the outboard engine to be handled or operated easily, and the rubber packing material can be prevented from being overheated to increase the life thereof.

This invention is not to be limited by the embodiments shown in the drawings and described in the description, which are given by way of example and not of limitation, but only in accordance with the scope of the appended claims.

We claim:

1. In combination: a casing adapted to mount an outboard internal combustion engine, said casing forming an internal discharge chamber with an opening at its top end, and a discharge passage having a discharge port near is lower end;

an exhaust pipe in said discharge chamber having its inlet near the said top end and its outlet in said discharge chamber, said exhaust pipe being adapted to be connected to an exhaust port of said engine;

a cooling water discharge pipe having its inlet connected to the outlet of a cooling system for said engine and its outlet in said internal discharge chamber; and a water storage chamber formed between the casing and the exhaust pipe and extending fully peripherally around the exhaust pipe in heat transfer relationship to the exhaust pipe, cooling water inlet means to, and cooling water outlet means from, said water storage chamber, whereby during engine operation circulation of water through said water storage chamber cools the exhaust pipe; said cooling water outlet means extending from near the bottom of said water storage chamber to the outside of the casing, and including a restricted discharge passage which is so proportioned as to maintain in said water storage chamber a sufficient quantity of cooling water during engine operation to keep the exhaust pipe temperature at an acceptable value, water from said water storage chamber discharging from said water storage chamber only through said restricted discharge passage.

2. A combination according to claim 1 in which an internal flange is formed on said casing inside said discharge chamber spaced below the said top end of the casing, and an external flange is formed on the outside of the exhaust pipe spaced from said inlet port of said exhaust pipe, said flanges making a fluid seal with one another and forming the bottom of said water storage chamber.

3. A combination according to claim 1 in which said cooling water inlet means is adapted to be connected to the supply end of the engine coolant water system.

4. A combination according to claim 1 in which an upper exhaust gas discharge means extends from said internal discharge chamber through the casing at an elevation substantially above said discharge port.

5. A combination according to claim 4 in which said upper exhaust gas discharge means discharges to said cooling water outlet means.

6. In combination: a casing adapted to mount an outboard internal combustion engine, said casing forming an internal discharge chamber with an opening at its top end, and a discharge passage having a discharge port near its lower end;

an exhaust pipe in said discharge chamber having its inlet near the said top end and its outlet in said discharge chamber, said exhaust pipe being adapted to be connected to an exhaust port of said engine;

a water storage chamber formed between the casing and the exhaust pipe in heat transfer relationship to the exhaust pipe, cooling water inlet means to, and cooling water outlet means from, said water storage chamber, whereby during engine operation circulation of water through said water storage chamber cools the exhaust pipe, said cooling water outlet means including a restricted discharge passage near the bottom of said water storage chamber, a port through said casing, and an enlarged passage between the restricted discharge passage and the last-named port; and upper exhaust gas discharge means extending from said internal discharge chamber through the casing to an elevation substantially above said discharge port, and there discharging into said enlarged passage, from which its contents and water from said water storage chamber pass through said last-named port, said last-named elevation being sufficiently higher than the exit from said restricted discharge passage as to prevent water from the water storage chamber from backing into said exhaust gas discharge means.

7. A combination according to claim 6 in which the said exhaust gas discharge means includes an upright conduit which enters the cooling water outlet means at said last-named elevation.

8. A combination according to claim 6 in which a vent to atmosphere is formed through the casing from an upper region of the water storage chamber.

9. In combination: a casing adapted to mount an outboard internal combustion engine, said casing forming an internal discharge chamber with an opening at its top end, and a discharge passage having a discharge port near its lower end;

a cooling water discharge pipe in said chamber having its only inlet adjacent to the said top end and its only outlet in said discharge chamber at a first elevation therein, said inlet being adapted to be communicated with the cooling water outlet from said engine;

an exhaust pipe in said discharge chamber having its only inlet near the said top end and every outlet therefrom which discharges into said discharge chamber being at a respective elevation therein which is higher than said first elevation, whereby to discourage backflow of exhausted cooling water into said exhaust pipe, said exhaust pipe being adapted to be connected to said exhaust port of said engine, both of said elevations being higher than the said discharge port;

a water storage chamber formed between the casing and the exhaust pipe in heat transfer relationship to the exhaust pipe, cooling water inlet means to, and cooling water outlet means from, said water storage chamber, whereby during engine operation circulation of water through said water storage chamber cools the exhaust pipe, said cooling water discharge pipe and said exhaust pipe being the sole source of exhausted cooling water and of exhaust gas discharging into said inernal discharge chamber; and an internal flange formed on said casing inside said discharge chamber spaced below the said top end of the casing, and an external flange formed on the outside of the exhaust pipe spaced from said inlet port of said exhaust pipe, said flanges making a fluid seal with one another and forming the bottom of said water storage chamber.

10. In combination: a casing adapted to mount an outboard internal combustion engine, said casing forming an internal discharge chamber with an opening at its top end, and a discharge passage having a discharge port near its lower end;

an exhaust pipe in said discharge chamber having its inlet near the said top end and its outlet in said discharge chamber, said exhaust pipe being adapted to be connected to an exhaust port of said engine;

a water storage chamber formed between the casing and the exhaust pipe and extending fully peripherally around the exhaust pipe in heat transfer relationship to the exhaust pipe, cooling water inlet means to, and cooling water outlet means from, said water storage chamber, whereby during engine operation circulation of water through said water storage chamber cools the exhaust pipe; said cooling water outlet means extending from near the bottom of said water storage chamber to the outside of the casing, and including a restricted discharge passage which is so proportioned as to maintain in said water storage chamber a sufficient quantity of cooling water during engine operation to keep the exhaust pipe temperature at an acceptable value, water from said water storage chamber discharging from said water storage chamber only through said restricted discharge passage; and an internal flange formed on said casing inside said discharge chamber spaced below the said top end of the casing, and an external flange formed on the outside of the exhaust pipe spaced from said inlet port of said exhaust pipe, said flanges making a fluid seal with one another and forming the bottom of said water storage chamber.

11. A combination according to claim 10 in which an upper exhaust gas discharge means extends from said internal discharge chamber through the casing at an elevation substantially above said discharge port.

12. A combination according to claim 10 in which said upper exhaust gas discharge means discharges to said cooling water outlet means.

* * * * *